United States Patent [19]

Samejima et al.

[11] Patent Number: 4,556,470

[45] Date of Patent: Dec. 3, 1985

[54] ELECTROLYTIC CELL WITH MEMBRANE AND SOLID, HORIZONTAL CATHODE PLATE

[75] Inventors: Yasushi Samejima, Kakogawa; Minoru Shiga, Himeji; Toshiji Kano, Kakogawa; Kiyoshi Yamada, Kobe, all of Japan

[73] Assignee: Kanegafuchi Kagaku Kogyo Kabushiki Kaisha, Osaka, Japan

[21] Appl. No.: 599,135

[22] Filed: Apr. 11, 1984

[30] Foreign Application Priority Data

Apr. 16, 1983 [JP] Japan ..... 58-67419

[51] Int. Cl.[4] ..... C25B 1/46

[52] U.S. Cl. ..... 204/266; 204/251; 204/263

[58] Field of Search ..... 204/98, 128, 251, 263–266, 204/252

[56] References Cited

U.S. PATENT DOCUMENTS

| | | | |
|---|---|---|---|
| 1,109,311 | 9/1914 | Allen | 204/251 |
| 1,187,903 | 6/1916 | Greenawalt | 204/251 |
| 2,749,301 | 6/1956 | Rosenbloom | 204/251 |
| 3,677,926 | 7/1972 | Davis | 204/251 |
| 3,728,234 | 4/1973 | Saki et al. | 204/237 |
| 3,893,897 | 7/1975 | Raetzsch et al. | 204/98 |
| 3,901,774 | 8/1975 | Montani et al. | 204/128 |
| 3,923,614 | 12/1975 | DeNora et al. | 204/99 |
| 4,036,714 | 7/1977 | Spitzer | 204/251 |
| 4,101,407 | 7/1978 | Hilaire et al. | 204/251 |
| 4,144,161 | 3/1979 | Bourgeois | 204/229 |

*Primary Examiner*—Andrew H. Metz
*Assistant Examiner*—Terryence Chapman
*Attorney, Agent, or Firm*—Armstrong, Nikaido Marmelstein & Kubovcik

[57] ABSTRACT

An electrolytic cell is disclosed comprising an upper anode compartment and a lower cathode compartment partitioned by a cation exchange membrane, in which partitioning spacers are provided on a cathode plate in order to eliminate the troubles owing to non-uniform flow of catholyte liquor, non-uniformity of anode-cathode gap, coarse surface of the cathode plate and the like.

9 Claims, 6 Drawing Figures

ELECTROLYTIC CELL WITH MEMBRANE AND SOLID, HORIZONTAL CATHODE PLATE

BACKGROUND OF THE INVENTION

1. Field of the Invention

The present invention generally relates to an electrolytic cell for electrolysis of an aqueous alkali metal halide solution, especially an aqueous alkali metal chloride solution. More particularly, it relates to an apparatus for mainly obtaining a high quality caustic alkali more effectively with low cell voltage using a horizontal type electrolytic cell providing a cation exchange membrane as an electrolytic separator.

2. Description of Prior Art

The horizontal type electrolytic cell is partitioned by an asbestos diaphragm positioned substantially horizontal into an upper anode compartment and a lower cathode compartment and has been in considerably widespread use industrially, because of an advantage that the product, for example, caustic alkali is produced in the cathode compartment, therefore, does not move to the anode compartment through the diaphragm.

The most typical horizontal electrolytic cell is a mercury electrolytic cell but destined to be shut down in the near future since mercury served as a cathode contaminates environment. When such a mercury cathode electrolytic cell is desired to be converted into a separator electrolytic process employing no mercury with a reduced cost, the separator electrolytic process should be of a horizontal type. In view of the situation, it is a significant matter the industry is now encountering to develop a process for producing a high quality product, not inferior to a product by the mercury process, with a high current efficiency using such horizontal type separator electrolytic cells.

A process for retrofitting a mercury cell to a horizontal type separator cell is revealed in U.S. Pat. No. 3,923,614. In the patent, however, a porous membrane (asbestos diaphragm) is used to serve as a separator, having great water permeability and accordingly anolyte solution passes through the separator hydraulically to thus mingle in, for example, caustic alkali produced in the cathode compartment, thereby resulting in decreased quality.

On the other hand, a cation exchange membrane called a nonporous membrane permits no passage of anolyte solution or catholyte liquor hydraulically, allowing only water molecules coordination-bonded to alkali metal ions transported electrically to pass, hence a high quality caustic alkali being obtained. To the contrary, a small quantity of water transported evaporates to cause electric conduction failure between a membrane and a cathode, in the long run to terminate electrolytic reaction.

U.S. Pat. No. 3,901,774 proposes processes to solve the problems; one is a process for placing a liquid maintaining material between a cation exchange membrane and a cathode and another is a process for carrying out the electrolysis while supplying into a cathode compartment an aqueous caustic alkali solution in the form of mist or spray in order to maintain electric conductivity.

Notwithstanding, the former process not only involves the problems including troubles for interposing the liquid maintaining material and the durability thereof, but increases cell voltage because the distance between electrodes is expanded by the liquid maintaining material located between the cation exchange membrane and the cathode, besides an increase in electric resistance of the liquid maintaining material per se. Hence it can not be an advantageous process. Moreover the latter process has some difficulties in practice on an industrial scale since the uniform supply of liquid is difficult when applied to a large-scale electrolytic cell such as employed commercially.

In an attempt to eliminate the foregoing defects attendant on the conventional processes, a process and apparatus therefor has been developed by the present applicant and proposed by U.S. Ser. No. 434,737 (EPC Appln. No. 82109528). This proposal involves an electrolytic process characterized in that hydrogen gas generated on a cathode is allowed to be enfolded in a stream of catholyte liquor and removed out of a cathode compartment, and electrolytic cell which is characterized by an upper anode compartment and a lower cathode compartment partitioned by a cation exchange membrane positioned substantially horizontal, said anode compartment having therein substantially horizontal anodes and being surrounded by a top cover, side walls positioned so as to enclose the anodes and the upper side of the membrane, and being provided with an inlet and an outlet of anolyte solution and an outlet of anode gas, said cathode compartment being surrounded by a cathode plate, side walls so as to enclose the cathode plate and the underside of the membrane, and being provided with an inlet of catholyte liquor and an outlet of a mixed stream of the cathode gas and the catholyte liquor.

However, during the course of further study, it has been found out by the inventors; (1) Non-uniform flow of catholyte liquor (mixed stream) and dead space occur owing to adhesion of cathode gas to the membrane. This dead space causes variation of pressure difference ($\Delta p$) in the flow of catholyte liquor (mixed stream) between catholyte liquor inlet and mixed stream outlet, brings about vibration of the membrane and damages the membrane through collision of the membrane with electrodes. (2) Maintaining of uniform anode-cathode gap is difficult. (3) When the cathode plate is not substantially flat on its surface (for instance, cathode plate having a concave-convex surface or a coarse surface) the membrane contacts with and rubs against the cathode plate to thus result in damage of the membrane. As a result, stable operation for a long period is prevented.

The present invention has been completed in order to eliminate the deficiencies attendant on the conventional processes as aforesaid and enables the retrofit of a mercury cell into a horizontal type cation exchange membrane cell with a relative ease, at the same time, achieving the production of a high quality caustic alkali with a high current efficiency. The present invention is, of course, useful in newly constructing a cell with new materials.

SUMMARY OF THE INVENTION

An object of the present invention is to obtain a high quality caustic alkali with high current efficiency using a horizontal type membrane electrolytic cell.

Another object of the present invention is to provide an improved horizontal type membrane electrolytic cell with high performance providing partitioning spacers sandwiched between the cathode and the membrane.

A further object of the present invention is to provide a horizontal type membrane electrolytic cell with high performance, a horizontal type cation exchange membrane electrolytic cell, in particular, made by retrofitting a mercury electrolytic cell.

Other objects of the present invention will be made apparent from the following description.

DETAILED DESCRIPTION OF THE INVENTION

Figure 1:
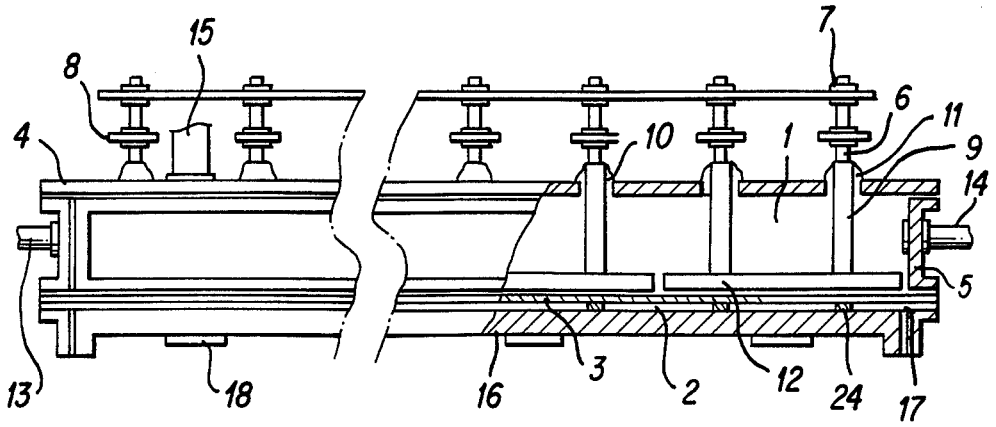
FIG. 1 and FIG. 2 are a partial cutaway front view showing an embodiment of the present electrolytic cell and a side sectional view of the electrolytic cell shown by FIG. 1.

The present invention encompasses an electrolytic cell comprising an upper anode compartment and a lower cathode compartment partitioned by a cation exchange membrane positioned substantially horizontal, said anode compartment having therein substantially horizontal anode plates and being surrounded by a top cover, side walls positioned so as to enclose the anodes and the upper side of the membrane, and being provided with at least one inlet of anolyte solution and at least one outlet of anolyte solution and/or anode gas, and said cathode compartment being surrounded by a cathode plate on which partitioning spacers are arranged at a suitable interval, side walls so as to enclose the cathode plate and the underside of the membrane, and being provided with at least one inlet of catholyte liquor and at least one outlet of a mixed stream of cathode gas and catholyte liquor.

Hereinafter, embodiments of the present invention will be explained in detail by referring to the drawings attached. The following explanation is referred, as a matter of convenience, to sodium chloride which is most popular in the industry and typical of alkali metal halides, and to caustic soda as an electrolytic product, but to which the present invention is not limited, the present invention being, needlessly, applied to the electrolysis of an aqueous solution of other inorganic salts, and the like.

Figure 2:
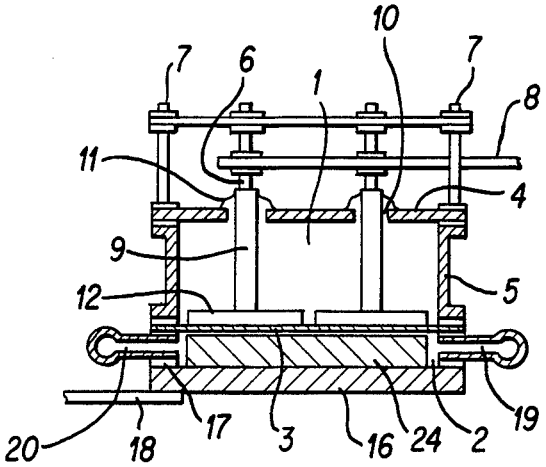

In FIG. 1 and FIG. 2, an electrolytic cell of the present invention is comprised of an anode compartment (1) and a cathode compartment (2) located thereunder, both compartments being of a rectangular shape having the greater length than the width, preferably several times the length. The anode compartment (1) and the cathode compartment (2) are separated from each other by a cation exchange membrane (3) positioned substantially horizontal by being sandwiched between side walls of the compartments. The word "substantially horizontal" also includes the cases where the membrane is positioned slightly slant (up to a slope of about 2/10). In FIG. 1, catholyte liquor inlet and outlet are omitted.

The cation exchange membrane used suitably in the present invention includes, for example, membranes made of perfluorocarbon polymers having cation exchange groups. The membrane made of a perfluorocarbon polymer containing sulfonic acid groups as a cation exchange group is sold by E. I. Du Pont de Nemours & Company under the trade mark "NAFION" having the following chemical structure;

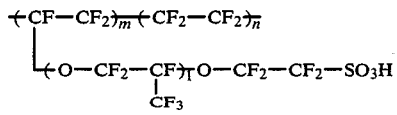

The equivalent weight of such cation exchange membranes is preferred in a range between 1,000 and 2,000, more preferably in a range between 1,100 and 1,500. The equivalent weight herein means weight (g) of a dry membrane per equivalent of an exchange group. Moreover membranes whose sulfonic acid groups are substituted, partly or wholly, by carboxylic acid groups and other membranes widely used can also be applied to the present invention. These cation exchange membranes exhibit very small water permeability so that they permit the passage of only sodium ion containing three to four molecules of water, while hindering the passage of hydraulic flow.

The anode compartment (1) is formed by being surrounded by a top cover (4), side walls (5) of the anode compartment located so as to enclose anodes comprising anode conducting rods (6), anode conducting rod covers (9) and anode plates (12) and the upper side of a cation exchange membrane (3). The anode conducting rods (6) are suspended by anode-suspending devices (7) located on the top cover (4) and connected electrically to one another by an anode busbar (8). The top cover (4) possesses holes (10) through which anode conducting rod covers (9) are inserted and the holes (10) are sealed airtight by sheets (11). To the lower ends of the anode conducting rods (6) are anode plates (12) secured. As such, the anode plates (12) are connected to the anode-suspending devices (7), so that those can be ascended and descended by the adjustment of the anode-suspending devices (7), thereby being positioned so as to come into contact with the cation exchange membrane (3). Of course, the anodes may also be suspended by other means, not being limited to the cases where those are suspended from the anode-suspending devices positioned to the top cover. Moreover the anode compartment is provided with at least one anolyte solution inlet (13), which may be positioned to the top cover (4) or side walls (5) of the anode compartment. On the other hand, at least one anolyte solution outlet (14) is provided and may be positioned to the side walls (5). Furthermore, to a suitable place of the top cover (4) or the side walls (5), anode gas (chlorine gas) outlet (15) is provided. Anode gas may also be removed through the anolyte solution outlet (14) together with anolyte solution.

As the material for the top cover (4) and side walls (5) forming the anode compartment (1), a top cover and side walls of an anode compartment of a mercury electrolytic cell may also be served. and any chlorine-resistant material may be effectively used. Examples of such materials are chlorine-resistant metals such as titanium and an alloy thereof, fluorocarbon polymers, hard rubbers and the like. Moreover iron lined with the foregoing metals, fluorocarbon polymers, hard rubbers and the like may also be employed.

As the anode plate (12) on which the anode reaction takes place, a graphite anode may also be used, but a dimensionally stable anode made of metals such as titanium and tantalum coated with platinum group metals, platinum group metal oxides or mixtures thereof is preferred to use. Of course, anode plates used in a mercury electrolytic cell may be directly diverted without altering dimensions and shapes.

Figure 3:
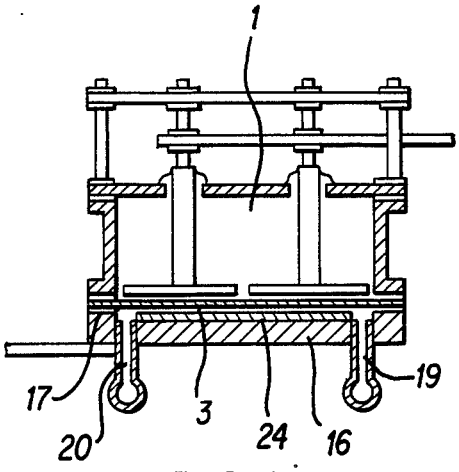
FIG. 3 and FIG. 4 are side sectional views illustrating other embodiments.
Figure 4:
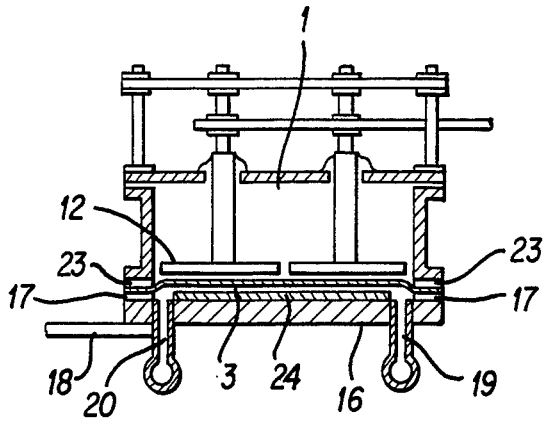

The cathode compartment (2), on the other hand, is formed by being surrounded by the underside of the cation exchange membrane (3), a cathode plate (16) on the surface of which partitioning spacers (24) are arranged in parallel and side walls (17) of the cathode compartment positioned so as to enclose the cathode plate along the periphery of the cathode plate. The side walls (17) of the cathode compartment may be made of those such as frames having some rigidity or may also be made of packing-like elastic materials such as rubbers, plastics and the like. Furthermore, as shown in FIG. 3 the portion of the bottom plate opposing the anodes through the cation exchange membrane is shaved off except the periphery and the remaining bank-like periphery of the cathode plate is served as the side walls of the cathode compartment. Moreover the cathode compartment may be formed as illustrated by FIG. 4; that is, a thin layer packing (23) is placed on the periphery of the cathode plate (16), the anode plates (12) are located upper than the lower flange level of side walls forming the anode compartment and the cation exchange membrane (3) is located along the iniside surfaces of the side walls of the anode compartment utilizing the flexibility of the membrane to thus form the cathode compartment.

As the material for the side walls (17) of the cathode compartment, any material resistant to caustic alkali such as sodium hydroxide may be used including, for example, iron, stainless steel, nickel and an alloy thereof in addition to the materials listed above for the side walls of the anode compartment. Iron base material lined with alkaliresistant materials may also be suitably used. Materials such as rubbers and plastics may also be used. As those materials, there are exemplified rubbers such as natural rubber, butyl rubber and ethylene-propylene rubber (EPR), fluorocarbon polymers such as polytetrafluoroethylene, copolymers of tetralfuoroethylene and hexafluoropropylene and copolymers of etylene-tetrafluoroethylene, polyvinyl chloride and reinforced plastics (FRP).

As the cathode plate (16) used in the present invention, a bottom plate used in a mercury electrolytic cell may be economically served. The surface of the bottom plate becomes coarse owing to corrosion, errosion caused by mercury, electrical short-circuit and the like, and therefore when the bottom plate is directly served, the cation exchange membrane occasionally rubs against the coarse surface to thereby be damaged. Hence, it is desired to smooth the surface before serving. The smoothing may be attained by plating with nickel, cobalt, chrome, molybdenum, tungsten, plutinum group metals, silver and the like, bonding of a thin metal plate made of nickel, austenitic stainless steel and the like, mechanical polishing or other suitable manners. It is a preferred embodiment to employ the cathode plate, the surface of which was subjected to plasma or flame spray with nickel cobalt, chrome, molybdenum, tungsten, platinum group metals, silver, alloys of foregoings or mixtures of foregoings to reduce hydrogen overvoltage. To the surface of the cathode plate, electro-plating or electro-dispersion plating may be also preferably applied to reduce hydrogen overvoltage with, for example, Raney nickel including or not including plutinum group metals such as plutinum, ruthenium, palladium and the like.

On the foregoing cathode plate (16), are partitioning spacers (24) provided at a suitable interval. The size and the interval of the partitioning spacers (24) had better be optionally determined according to the construction of the cell and operating conditions. For example, strips having height of about 0.5 to about 5 mm and width of about 3 to about 15 mm may be provided at an interval of about 10 cm to about 1 m. The partitioning spacers are preferably arranged in parallel, but are not necessarily limited thereto. The material of the partitioning spacers may include alkali-resistant rubbers and plastics, metals such as iron whose surface was, partly or wholly (at least, top), covered with the foregoings rubber, plastics and the like. Moreover, plastics having electro-conductivity may also be used. The partitioning spacers (24) may, for example, be sandwiched between the anode plates (12) and the cathode plate (16) or embedded in the cathode polate (16) by adhesives or mechanical means. Furthermore, when the spacers (24) united to the side walls of the cathode compartment (17), it is possible to provide the spacers concurrently with assembling of the side walls of the cathode compartment. One of preferred embodiments is to employ a packing-like elastic material served as the cathode compartment side walls (17) to which the partitioning spacers (24) are united, and to allow the side walls to function as packings (23) simultaneously, as exhibited by FIG. 5. In this example, a bottom plate used in a mercury electrolytic cell is served as the cathode plate (16) and bolt holes made originally are utilized as bolt holes (25) for assembly as well as catholyte liquor inlets (outlets) (25*a*), so that assembling of the cathode compartment side walls (17), packings (23), partitioning spacers (24), catholyte liquor inlet (19) and outlet (20) can be achieved at one stroke.

Figure 5:
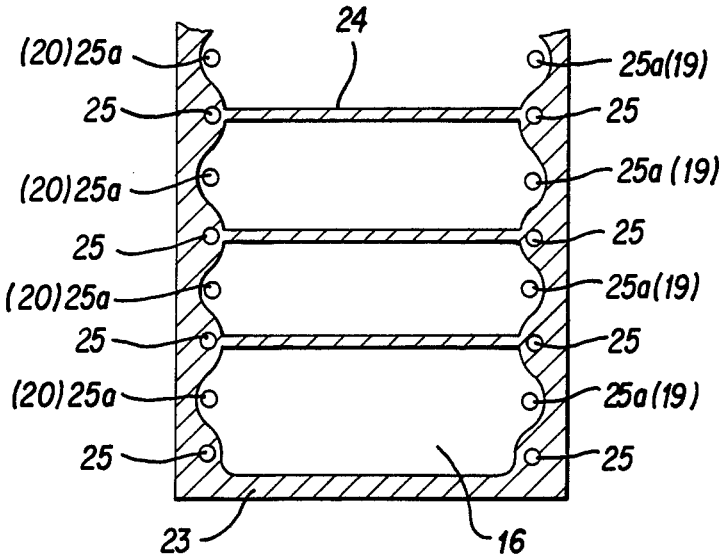
FIG. 5 is a schematic illustration of the principal portion depicting a still further embodiment.

The partitioning spacers (24) are arranged along the flow of catholyte liquor (mixed stream). The catholyte liquor inlet (19) and the mixed stream outlet (20) had better be provided so as to cause flowing of said mixed stream to take plaace. Accordingly, the mixed stream may be allowed to flow either along the longitudinal way or traverse way of a rectangular-shaped cell, but the latter is preferred since the pressure difference ($\Delta p$) resulting from non-uniform flow is reduced, the value of $G/(L+G)$ (gas content contained in unit volume of mixed stream of catholyte liquor and cathode gas) is minimized, in consequence, reinforcement of the cathode plate and the top cover may be omitted or minimized. In an attempt to attain such purpose, a slit-like inlet is a preferred embodiment. Moreover, as shown by FIG. 3 to FIG. 5, the inlet (19) and the outlet (20) may be provided, respectively, to the end of the cathode plate (16). In the event that the inlet and the outlet are comprised of incontinuous holes such as depicted by FIG. 5, the interval of the partitioning spacers had better be agreeable to pitches of the holes or every two or three pitch.

The partitioning spacers (24) may preferably be provided as well along the flowing of catholyte liquor (mixed stream) in the traverse direction rather than the longitudinal direction of the rectangular cell. The spacers (24) may not necessarily be continuous from the catholyte liquor inlet (19) to the mixed stream outlet (20), but intermittent.

Figure 6:
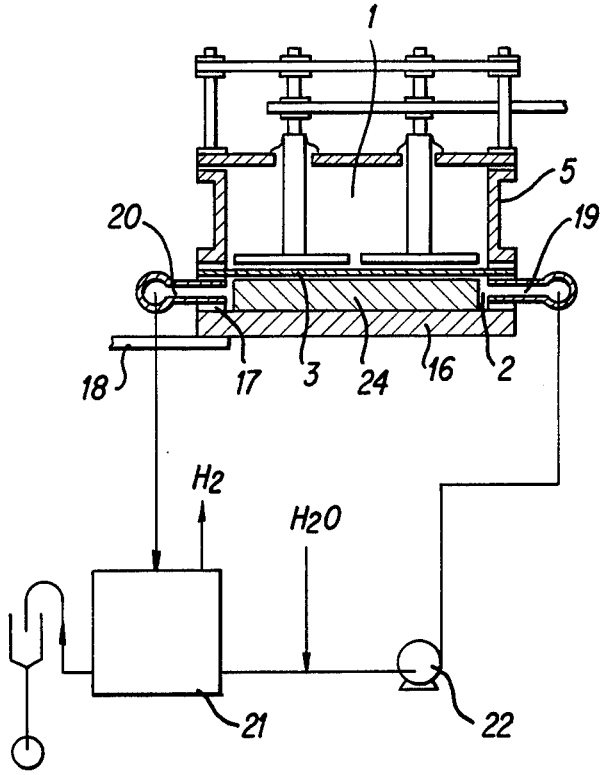
FIG. 6 shows an aqueous caustic alkali liquor-circulating system in carryingout the electrolysis by the use of an electrolytic cell shown by FIG. 2.

In FIG. 6, there is depicted a sectional view of a horizontal type cation exchange membrane electrolytic cell retrofitted from a mercury electrolytic cell according to the present invention, including a catholyte liquor circulating system.

In FIG. 1 and FIG. 6, an anode compartment (1) is formed by being surrounded by a top cover (4), side walls (5) of the anode compartment provided so as to enclose a plurality of anode conducting rods (6) and anode plates (12) and the upper side of a cation exchange membrane (3) positioned by being sandwiched between the lower flange of anode compartment side walls (5) and cathode compartment side walls (not shown). The anode conducting rods (6) are suspended vertically by anode-suspending devices (7) located protruding at the top cover (4) and connected electrically to each other by a busbar (8). The anode compartment (1) is provided with an anolyte solution inlet (13), an anolyte solution outlet (14) and an anode gas outlet (15).

On the other hand, a cathode compartment (2) is formed by being surrounded by a cathode plate (16), directly served from a bottom plate of a mercury electrolytic cell, smoothed, if required, on the surface of which partitioning spacers (24) are provided, cathode compartment side walls positioned at the periphery of the cathode plate (16) and the underside of the cation exchange membrane (3). The cathode plate (16) is connected to a cathode busbar (18). The cathode compartment (2) is provided with a catholyte liquor inlet (19) and an outlet (20) of a mixed stream of catholyte liquor and cathode gas.

An approximately saturated brine is supplied through the anolyte solution inlet (13) into the anode compartment (1) and then electrolysed therein. Chlorine gas generated is removed through the anode gas outlet (15) and the depleted brine is discharged through the anolyte solution outlet (14).

The catholyte liquor is supplied through the catholyte liquor inlet (19) into the cathode compartment (2) and mixed with hydrogen gas evolved in the cathode compartment to provide a mixed stream, discharged through the outlet (20) of the mixed stream, then the mixed stream being transported to a separating tank (21) in which hydrogen gas is separated from caustic liquor. The aqueous caustic alkali solution containing substantially no hydrogen gas is recirculated by use of a pump (22) through the catholyte liquor inlet (19) to the cathode compartment (2).

The separating tank (21) and the pump (22) may be one, respectively, for a plurality of cells, otherwise, for each cell.

The electric current is supplied to an anode busbar (8), passed through the bottom plate (16) of the cathode compartment (2) and then taken out from a cathode busbar (18).

In the anode compartment (1), the following reaction takes place;

$$Cl^- \xrightarrow{-e^-} \tfrac{1}{2}Cl_2$$

Sodium ions in the anode compartment (1) move through the cation exchange membrane (3) to the cathode compartment (2). In the cathode compartment (2), on the other hand, the following reaction occurs;

$$H_2O \xrightarrow{+e^-} \tfrac{1}{2}H_2 + OH^-$$

In the cathode compartment sodium hydroxide is produced by reaction of hydroxyl ions with sodium ions transparent through the cation exchange membrane (3) from the anode compartment (1), concurrently with evolution of hydrogen gas.

In the electrolysis using a cation exchange membrane, a vertical type cell is commonly employed. In this case, cathode gas generated in the cathode compartment is rapidly removed behind the cathode (i.e., to an opposite direction to the cation exchange membrane), and hence a porous cathode fabricated of expanded metal sheets, perforated metal sheets, metal nets and the like with a view to reducing electric resistance of the catholyte liquor may be used.

Nonetheless, in the case of a horizontal type cell it is impossible to remove cathode gas with a small specific gravity compared with catholyte liquor behind the cathode, i.e., under the cathode located extending to a horizontal way.

Therefore, the greatest feature of the present invention lies in that into the cathode compartment comprised of the underside of the cation exchange membrane (3) and the cathode plate (16) with gas-liquid impermeability positioned adjacent thereto, catholyte liquor is supplied and the cathode compartment is filled therewith to thus form a mixed stream of catholyte liquor and cathode gas, with which the underside of the cation exchange membrane (3) is wetted to allow the electrolysis reaction to take place smoothly, at the same time, sodium hydroxide and cathode gas produced in a space between the cation exchange membrane (3) and the cathode plate (16) are enfolded in the stream, then discharged outside the cathode compartment (2).

It is advantageous to recirculate back to the catholyte liquor inlet (19) at least a part of the catholyte liquor which is supplied into the cathode compartment, removed together with cathode gas and caustic soda produced and then separated from hydrogen gas by the separating tank (21), since the concentration of caustic soda can be increased optionally and adjusted by being diluted with water.

As was stated earlier, the present invention is capable of retrofitting mercury electrolytic cells to cation exchange membrane electrolytic cells very feasibly, and therefore almost all existing equipments including busbars, rectifiers, disposal equipments of depleted brine and brine system equipments as well as electrolytic cells can be served without being scrapped. The present invention further prevents troubles due to non-uniform flow of catholyte liquor (mixed stream), non-uniformity of anode-cathode gap, coarse surface of the cathode plate and the like, to thus enable long-term stable operation.

What we claim is:

1. An electrolytic cell comprising an upper anode compartment and a lower cathode compartment, said compartments being partitioned by a cation exchange membrane positioned substantially horizontally, said anode compartment having therein substantially horizontal anode plates and being surrounded by a top cover, side walls positioned so as to enclose the anodes and the upper side of the membrane, and being provided with at least one inlet of anolyte solution and at least one outlet of anolyte solution and/or anode gas, and said cathode compartment being surrounded by a solid and substantially imperforate cathode plate on which one or more partitioning spacers are arranged at a suitable interval, side walls so as to enclose the cathode plate and the underside of the membrane, and being provided with at least one inlet of catholyte liquor and at least one outlet of a mixed stream of cathode gas and catholyte liquor.

2. The electrolytic cell of claim 1, wherein said partitioning spacers are made of alkali-resistant rubbers.

3. The electrolytic cell of claim 1, wherein said partitioning spacers are made of alkali-resistant plastics.

4. The electrolytic cell of claim 1, wherein said partitioning spacers are made of rigid materials, the surface of which is, partly or wholly, covered with rubbers or plastics.

5. The electrolytic cell of claim 1, wherein said partitioning spacers are sandwiched between the anodes and the cathode plate together with the cation exchange membrane.

6. The electrolytic cell of claim 1, wherein said partitioning spacers are embedded in the cathode plate.

7. The electrolytic cell of claim 1, wherein said partitioning spacers are united to side walls of the cathode compartment.

8. The electrolytic cell of claim 7, wherein said partitioning spacers and the side walls of the cathode compartment are made of packing-like elastic materials.

9. The electrolytic cell of claim 1, wherein said inlet of catholyte liquor is provided to one of long sides of said cathode plate or a side wall thereabove and said outlet of the mixed stream of cathode gas and catholyte liquor to the opposite long side or side wall thereabove, and said partitioning spacers are arranged with the flowing direction of the mixed stream.

* * * * *